US005147000A

United States Patent [19]

Kaalstad

[11] Patent Number: 5,147,000

[45] Date of Patent: Sep. 15, 1992

[54] DISC DRILL BIT

[75] Inventor: Oscar Kaalstad, Winter Springs, Fla.

[73] Assignee: Norvic S.A., Fribourg, Switzerland

[21] Appl. No.: 767,225

[22] Filed: Sep. 27, 1991

Related U.S. Application Data

[63] Continuation-in-part of Ser. No. 540,161, Jun. 19, 1990, Pat. No. 5,064,007.

[51] Int. Cl.[5] ..... E21B 10/12

[52] U.S. Cl. ..... 175/334; 175/351; 175/355; 175/365; 175/408

[58] Field of Search ..... 175/339, 351, 352, 373, 175/374, 334, 336, 354–355, 371–373, 365

[56] References Cited

U.S. PATENT DOCUMENTS

| | | | |
|---|---|---|---|
| 334,594 | 1/1886 | Maloy | 175/351 |
| 1,026,886 | 5/1912 | Thomas | 175/351 |
| 1,143,274 | 6/1915 | Hughes | 175/351 |
| 1,582,332 | 4/1926 | Brutus | 175/351 |
| 1,747,908 | 2/1930 | Seifert | 175/351 |
| 2,201,219 | 5/1940 | Bell | 175/351 |
| 4,549,614 | 10/1985 | Kaalstad et al. | 175/339 |

*Primary Examiner*—Ramon S. Britts
*Assistant Examiner*—Frank S. Tsay
*Attorney, Agent, or Firm*—Kane, Dalsimer, Sullivan, Kurucz, Levy, Eisele and Richard

[57] ABSTRACT

A drill bit for use in drilling a well bore comprises a main drill body adapted to be rotated about a substantially vertically disposed axis of rotation and having therein a duct extending longitudinally along such axis, for supplying a drill fluid under pressure to the well bore. At least one generally circular, rotatable cutting discs are mounted on the outside of the main drill body at equally spaced locations, with the cutting discs each having cutting elements disposed in a ring-shaped array. Each of the cutting discs has an axis of rotation disposed at an acute angle to the vertical centerline about which the main drill body rotates. The axis of rotation of each cutting disc is slightly offset laterally in a rearward direction from the centerline of the main drill body, thus to cause the entire bit to be placed in a non-equilibrium position with the rotation of the main body enabling the cutting disc to be positioned to be particularly effective and aggressive in cutting the well bore.

28 Claims, 10 Drawing Sheets

DISC DRILL BIT

This is a continuation-in-part of co-pending Ser. No. 07/540,161, filed on Jun. 19, 1990, now U.S. Pat. No. 5,064,007.

The present invention concerns a drilling device comprising a drilling head equipped with a rotating body through which runs a duct for supplying drilling fluid or air to the well bore, and at least one cutting disc placed on the outside of the main body.

Existing drilling devices comprising a drilling head equipped with three cutting elements markedly conical or in the shape of a truncated cone have been known and in use since the 1930's. These devices require great pressure to break the rock, and subsequently cut it up and flush it away. Because of the great compression needed to break the rock, such devices affect a greater surface than that of the drilling, thus creating an irregular drilling profile and an unstable wall.

The present invention makes it possible to produce a drilling device operating at low power, and reduced down pressure, utilizing at least one cutting element mounted on the outside of the drilling head, its axis of rotation being, according to a preferable embodiment, offset laterally in a backward direction from the center line of the main drill body in relation to the direction of rotation of the main body, enabling the device to penetrate and evacuate rock more rapidly than with other known methods The present invention aims to make it possible to produce a drilling device operating with a light thrust, utilizing preferably three cutting elements or discs easily mounted on the drilling head, and enabling it to evacuate large pieces of debris.

SUMMARY OF THE INVENTION

The drilling bit according to the present invention comprises, a main drill body designed to rotate about a substantially vertically disposed axis of rotation and incorporating one or more longitudinal ducts for either supplying a drill fluid or air under pressure to the well bore or removing a drill fluid air combined with debris and excavated rock from the well bore, intended to be assembled to a drill rod, at least one generally circular, rotatable cutting disc mounted on lower portion outside of the said main drill body, causing the said drill bit to form a well bore having a substantially cylindrical wall portion and a generally concave portion, the said cutting disc having cutting elements disposed in generally ring-shaped formations, with its axis of rotation disposed at an acute angle to the axis of rotation of the main body, the lowest cutting point of the said disc being radially remote in relation to the axis of rotation of the drill body, the axis of the cutting disc being slightly offset laterally in a rearward direction from the centerline of the main drill body in relation to the direction of rotation of the main body, while leaving all the angles between the axes unchanged, causing the drill bit to be placed in a non-equilibrium position, the rotation of the main body enabling the drill bit to seek equilibrium by the cutting elements penetrating the wall and shearing the rock as the combined downward forces exceed the opposing forces (making the drill bit self-loading), the downward force being essentially concentrated on the lowest cutting element causing a destabilization of the well wall making easier the cutting action of the bit.

Preferably the drill bit comprises three cutting discs.

The cutting element is a disc provided with highly efficient cutting surfaces (teeth).

Because the discs act at the bottom and on the concave portion of the wall to be cut and have a generally ring-shaped surface equipped with cutting means, the action of the discs is to primarily shear the rock and not to compress it in order to obtain its disintegration.

Because the axes of rotation of the discs are offset laterally backwards in relation to the direction of rotation of the main drill body, the cutting action of each disc is performed by, the teeth in the lower rear quadrant. Penetration of the rock is easily achieved as the net downward force (thrust) is essentially concentrated around the six o'clock position on each disc, which is an important factor in destabilizing the rock in the lower portion of the hole.

Movement of the earth's crust over many millions of years has subjected almost all rock to immense stresses and strains. These forces have been relieved by the formation of tiny fissures and faults in the rock. Most known drilling devices compress the rock they are about to cut, eliminating these faults and fissures, and then grind it with a rotary action.

Off-setting the axis of rotation of the cutting disc or discs laterally from the longitudinal axis of the main drill body places the entire bit in a non-equilibrium position. The rotation of the main drill body causes the disc or discs to seek equilibrium by penetrating and shearing the rock.

By off-setting the axis of rotation of the cutting disc in a rearward direction, the disc moves towards equilibrium as the cutting elements penetrate and shear the rock as the disc revolves on its axis as a result of the rotation of the main drill body. As the disc approaches equilibrium it is once again prevented from reaching it by the next tooth entering the rock just before six o'clock position and the cutting cycle is repeated.

How this is achieved is explained by FIG. 1 and FIG. 2 $F_L$ (downward load) is generated from the weight of the drill bit, drill pipe and drill rig loading. The downward load is essentially exerted on the lowest point or points in the six o'clock position, which maximizes penetration and destabilization of the rock.

In FIG. 1, the clockwise rotation of the main drill body (viewed from above said body) causes the cutting disc or discs to rotate in an anti-clockwise direction (viewed from the outer face of said disc or discs), so that once the cutting elements have penetrated the rock they move upward through it, resulting, in a downward thrust greater than the opposing force $(F_L+F_S)$ $F_O$ where $\Sigma F_{Si.\infty}$ the combined downward forces of the teeth in the cutting quadrant), thereby making the system self loading. The disc will therefore tend to screw itself into the rock, which has been destabilized, shearing it in an ascending spiral, making it self cleaning and allowing $F_L$ to become negligible. This is essentially carried out by the center ring of cutting elements or teeth (601, FIG. 10).

It is believed that during operation the following takes place. Penetration into and destabilization of the rock is achieved during the rapid transition of the cutting action from compressive to up-cut shearing. From the point at which it enters the rock, as it approaches the 6 o'clock position, the lowest tooth on the disc exerts into the rock a combination of downward thrust and rotational energy (or torque), originating from the pull-down on and rotation of the main drill body. This energy increases rapidly until it reaches a maximum when the tooth reaches the 6 o'clock position, after which it moves into an up-cut shearing action. Preferably, this phase is completed by each tooth before another enters the rock, but in another version one or more other teeth may enter the rock before the first tooth has reached full penetration.

Once the teeth have fully penetrated the rock and passed the 6 o'clock position, they have to overcome the resistance of the rock if the up-cut shearing or excavating action is to take place. As the teeth move upwards in the rock through the lower rear quadrant of the cutting disc the downward energy they exert on the rock progressively diminishes from its high point at 6 o'clock, becoming negligible as the teeth approach the 3 o'clock position. The lateral rearward offset of the axis of rotation of the disc in relation to the axis of rotation of the drill bit means that the teeth on the disc move farther away from the centerline of the drill bit as they move upwards from the 6 o'clock position, until they reach a maximum distance from the centerline on, or sometime after if the disc has been tilted down, they have passed the 3 o'clock position. The result of this outward movement is that the teeth exert a force on the rock in a direction parallel to the axis of rotation of the disc. This lateral force progressively increases as the teeth move away from the 6 o'clock position, reaching a maximum as the teeth reach the point that is the farthest perpendicular distance from the centerline of the hole. Thereafter the force diminishes rapidly as the teeth withdraw from the rock, ceasing altogether at the point at which they lose contact with the rock. Therefore, it is believed that the lateral force, combined with the acute angle of the disc to the centerline of the main drill body and the convex shape of the outer face of the disc, brings the teeth on the outer cutting ring into play, forcing them to enter the rock and excavate it with an up-cut shearing action.

An element of the outward lateral force exerted by the teeth on the outer face of the disc is counterbalanced by the inward lateral force exerted by the teeth on the inner cutting ring FIG. 10, 603. This inward force causes the teeth to enter, shear and excavate the rock in the center column at the base of the hole FIG. 10, 611, said column being left because, tat their lowest point, the teeth on the periphery of the cutting discs are radially remote from the centerline of the main body.

The teeth on the inner cutting ring excavate the central column and cease to be in contact with the rock face some time before the teeth on the outer ring cease to be in contact with the well wall. This means that there is a sudden falling off of the inward lateral pressure at the same time as the outward lateral pressure is increasing. The result is a torsional inward force on the cutting disc in the lower rear quadrant.

The torsional energy required to overcome the resistance of the rock to the combined effects of these interacting downward and lateral forces increases rapidly as the teeth first penetrate the rock, reaching a peak at the 6 o'clock position, it then reduces slowly as the increasing (but secondary) lateral force offsets the reducing (primary) downward force, only to reduce rapidly once the downward force has become negligible and the teeth begin to withdraw from the rock.

Because the cutting disc is rotating around its own axis a well as being rotated around the centerline of the main body, the speed with which the cutting teeth rotate around the centerline fluctuates compared to the rate of rotation of the main drill body. The magnitude of this fluctuation is affected by the extent to which the highest point on the periphery of the disc is radially remote from the lowest point—the amount of vertical tilt on the disc.

When a tooth is at 9 o'clock on the disc it is rotating at the same speed as the drill body. As it moves backwards, relative to the direction of rotation of the drill body, its own rotational speed drops, reaching its lowest speed at 6 o'clock—the point at which its downward movement becomes an upward movement—it then speeds up as it moves through the lower rear quadrant until, at 3 o'clock, it is once again moving at the same speed as the main body. As the tooth moves past 3 o'clock it continues to increase rotational speed relative to that of the main body, reaching it's highest speed at twelve o'clock before slowing down until both speeds match again at 9 o'clock.

Thus it is believed the combination of increasing tooth speed and reducing outward lateral pressure as the teeth withdraw from the rock that cause the teeth in the upper rearward quadrant to stop shearing and excavating the rock and to burnish the wall of the hole. Whilst there is still an outward lateral force in this quadrant its effect is believed to be a compressive one which compacts any loose rock and smooths the wall of the hole.

If the said cutting disc is then tilted in the direction of rotation of the said main drill body, the outer excavating teeth are pressed further into the rock increasing the work of the said outer excavating teeth and reducing the work done by the penetrating destabilizing teeth which increases the life of the said penetrating destabilizing teeth. The life of the outer excavating teeth can be extended by using highly wear resistant inserts such as diamond carbide, thereby extending the life of the bit. This is particularly valuable when the well bore being cut is very deep as it reduces the down-time caused by raising the bit to the surface to replace it when it is worn.

Because the net downward force on the bit is essentially concentrated on a single point, the tooth at six o'clock on the cutting disc, penetration into the rock is easily achieved in almost any known rock. The bit will therefore drill with little downward thrust and only a small increase is required to achieve full penetration if the teeth are lengthened. Most of the force needed to overcome the resistance in the rock is rotary and any increase in resistance is largely overcome by increasing the torque on the main drill body which is transferred to the cutting disc or discs.

In any bit using more than one disc it is necessary to have a different number of teeth on each disc to ensure that the cutting paths of the lowest teeth lie side by side. With the same number of teeth on each disc the cutting paths overlap in a regular repeating pattern that creates tracking and inhibits the destabilizing action of the lowest teeth and therefore the drilling process. The characteristics of the cutting path are partly determined by the configuration of the disc and its teeth.

If the lateral displacement of the axis of rotation were to be in a forward direction relative to the direction of rotation of the main drill body, the cutting action would be performed by the lower forward quadrant of the disc. Penetration of the rock would start just before the nine o'clock position, and move in a descending spiral with the penetration increasing until the teeth were fully embedded in the rock at the six o'clock position. (see FIG. 2).

The effect of this forward displacement would be to generate a force opposed to that needed to reach equilibrium, and to compress rather than destabilize the rock, making it harder to cut and putting undue stress on the cutting teeth and the bearing. The debris is also directed downwards towards the bottom of the hole which in certain rock conditions could cause the bit to jam in the hole.

The principle of this invention applies to a bit containing one or more cutting discs. According to another embodiment of the invention the upper portion of the said main drill body has a number of burnishing or cutting elements disposed at regular intervals around the periphery of the main drill body and situated no lower than the point at which the concave bottom portion of the well bore joins the cylindrical portion.

This invention facilitates faster straight line rock penetration with constant hole diameter, using less downward pressure and power, thereby substantially lowering the cost per foot of drilling.

In soft rock the volume of chippings or debris is considerably greater, so at small hole diameter the device is more effective with one or two rotating cutting discs leaving more space at the bottom of the hole to evacuate the debris. Normally the drill comprises three cutting discs.

The invention has the additional advantage of providing directionally stable drilling because the vector of the cutting force combined with the rotation of the main drill body creates a core of destabilization the apex of which lies below the bottom of the hole on the centerline of the main body. This directional stability is reinforced by the action of the burnishing or cutting elements in the upper portion of the main drill body which holds the bit in the center of the hole.

Another advantage of the burnishing elements is to ensure that the withdrawal movement of bit in the hole is operated in a straight line so avoiding the drill body to be deviated. If the drill body during the upwards or backward movement is deviated from the straight line a disc or more discs may be engaged in the wall of the hole causing either a failure or breakage of the disc or its bearing whereupon it will fall down the hole or remain in the wall of the hole, or cause the entire bit to become stuck in the wall of the hole thereby preventing successful withdrawal.

The device is designed to provide an aggressive cutting disc by off setting laterally in a backward direction the axis of rotation of each disc from the centerline of the main body relative to the direction of rotation of the main body. The amount of offset will vary according to the diameter of the bit and the configuration and design of the discs.

The ducts through which water, drilling mud or air pass out of the main body are designed to provide adequate flow to flush out the broken rock and to cool the discs during drilling. The burnishing or cutting elements on the upper portion of the main drill body are disposed in a polygonal and preferably hexagonal formation. We may call this formation a gauge ring. This gauge ring should preferably be equipped with highly wear resistant inserts which touch the wall of the well at a specified distance from the center of the hole at specified points around the diameter of the gauge ring. Therefore, even if the cutting elements on the discs should wear after extensive drilling, the gauge ring ensures a constant diameter of the hole by removing the residual rock not reached by the worn cutting surface of the discs. The inserts of the gauge ring will eventually be subject to wear as well, but in practice this system ensures hole diameter stability in most drilling applications beyond the point at which other traditional system would have already failed.

Although the inserts on the gauge ring will remove any residual rock left by worn cutting discs, they do not perform the removal a rapidly as the discs and a marked and progressive reduction in the rate at which drilling proceeds would b indicative of excessive wear on the discs.

The bottom central portion of the main drill body can be provided with cutting elements to remove residual "chimneys" of rock not directly reached by the cutting surfaces of the discs.

The cutting discs are provided with supplementary cutting elements disposed in a ring formation spaced out around and the disc and disposed behind the main cutting elements at an angle making them point towards the center of the hole in such a way that they will not impinge on the well wall when the main cutting elements are at work. The purpose of these subsidiary cutting elements is to jolt and cause to disintegrate any central chimney of rock forming in the center of the hole as the cutting discs rotate.

As should now be clear, the invention provides a self-aligning bit well suited to directionally stable drilling of constant diameter holes, using lighter and less costly equipment. Penetration rates are 20–400 percent faster than those achieved by traditional methods. The drill device has been engineered to withstand easily all the shocks, pressures and wear normally encountered in commercial drilling operations.

It is therefore apparent that a drill bit for use in drilling a well bore in accordance with this invention comprises a main body designed to rotate about a substantially vertically disposed axis of rotation and incorporating a longitudinal duct for supplying a drill fluid or air under pressure to the well bore.

In a further embodiment the bit will incorporate a central duct either passing through the center of bit or splitting into a number of directed ducts. Drill fluid or air combined with debris and excavated rock from the well bore will pass through this duct or ducts to remove said debris and excavated rock.

Three rotatable cutting discs are preferably mounted on the outside of the main drill body at equally spaced intervals, with these cutting discs having multiple cutting elements. Nevertheless, it is possible to have a drill provided with less or more discs. Each of the cutting discs has an axis of rotation disposed at an acute angle to the vertical axis about which the main drill body rotates, thus causing the cutting elements to be positioned in such a way as to achieve efficient aggressive cutting in the direction of rotation of the main drill body, and ensures that the first cutting element is the one approaching the lowest point of each disc.

The angle at which the axes of rotation of the cutting discs are disposed is typically 40 to 80 degrees to the axis of rotation of the main drill body.

A principal advantage of the invention is to provide a drill bit of inexpensive and highly effective construction, which drill bit is further characterized by being self-aligning, thus having the ability to drill in a directionally stable manner.

DETAILED DESCRIPTION

Although this description is limited to a drill bit equipped with three cutting discs, drill bits with one, two or more cutting discs correspond to the present invention.

Figure 3:
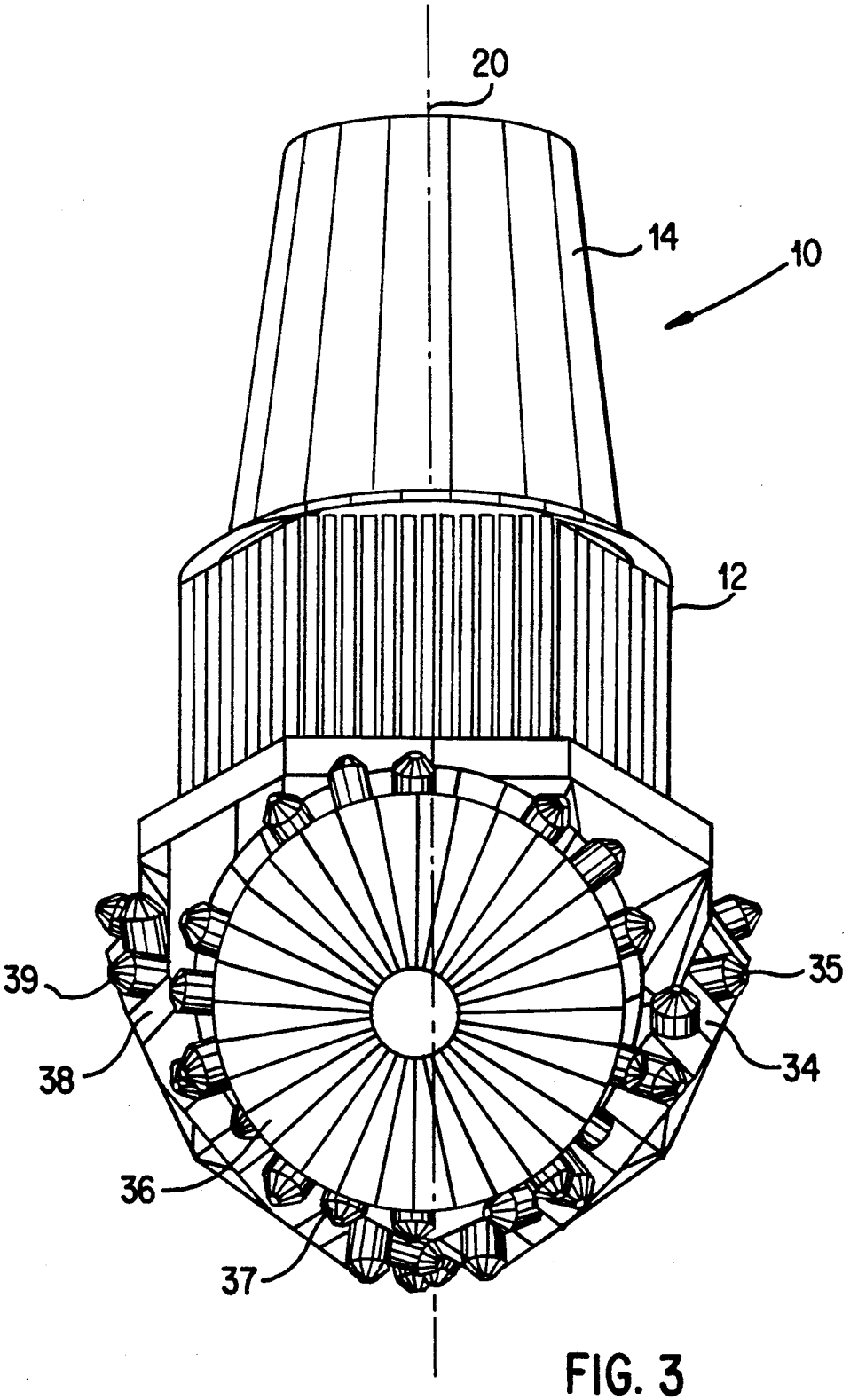
FIG. 3 is a perspective view of a drill bit provided with three cutting discs.

With reference to FIG. 3 a rotary drilling device 10 in accordance with this invention may be seen to comprise a body member or housing 12 fitted with male connector 14 at its uppermost portion, enabling it to be connected to a rotary drive system, in this instance a rotary drive shaft, called a drill rod, equipped with a corresponding female connector at its lowermost end. By engagement of the male and female part, the body member or housing 12 is enabled to be attached very tightly to the lowermost end of a drive shaft not shown, yet readily removed therefrom for replacement should this become necessary from time to time.

The power-applying shaft has a centrally disposed longitudinal hole to permit the flow of coolant therethrough, and the shaft is rotatable about a centerline or axis of rotation 20. The centerline may be regarded as also extending through the body member 12.

The body member 12 has a centrally located coolant duct located in alignment with the central hole of the shaft, with the duct of body member 12 opening into orifices provided for the circulation of drilling fluid or air under pressure to the area of the rotating discs or wheels 34, 36 and 38 mounted on the body member 12.

Each disc 34, 36, 38 is provided with cutting elements disposed in a ring shape formation, their length, shape, and disposition pattern depending on the condition of the rock to be cut.

Figure 4:
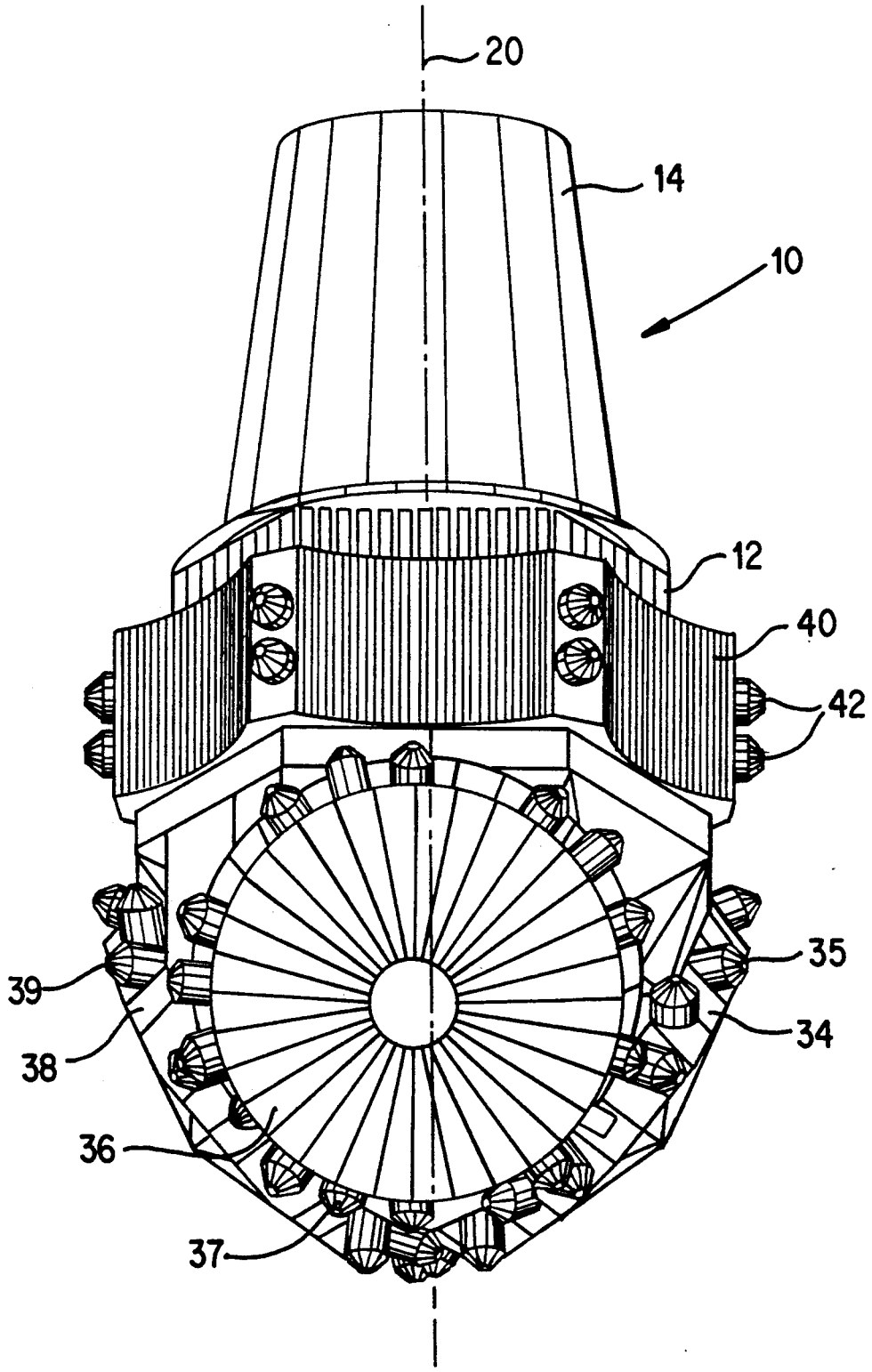
FIG. 4 is a perspective view of a drill bit as in FIG. 3 provided with a gauge ring.

In FIG. 4 a drill bit similar to this of FIG. 3 is shown, the only difference being the gauge ring 40 which is preferably of polygonal configuration. In accordance with this invention, burnishing inserts or teeth 42 are mounted at the intersection of each of the sides of the gauge ring, which may be regarded as forming the maximum diameter of the drill bit.

It will be noted with regard to the sides of the gauge ring, that each of the sides is concave, extending in towards the center of rotation of the bit from the intersection points on the outer diameter of the gauge ring at which the burnishing inserts or teeth are mounted. This construction maximizes the space available for pieces of rock and other cuttings to pass between the well wall and the concave faces of the gauge ring 40 and facilitates their removal from the disc area by means of the fluid used during operation of the drill bit. This detail is made quite clear in FIG. 5. The gauge ring 40 may be referred to as being in the shape or a modified polygon.

During extended drilling, the gauge ring 40 will ensure a constant diameter of the hole being created in the rock, in spite of the possibility that the cutting surface of the discs should wear, and thereby reduce the effective cutting diameter of the wheels or discs 34, 36 and 38. This reduction in cutting diameter is compensated for in accordance with this invention by the inserts 42 of the gauge ring 40 utilized at the maximum diameter, upper portion of the drill bit. These are of course highly wear resistant inserts located at each point that touches the hole created in the rock, as previously mentioned. Theoretically, the inserts or teeth 42 of the gauge ring 40 would eventually be subject to wear as well, but in practice this novel system will ensure a hole diameter stability in most drilling applications beyond the distance at which other conventional systems would already have failed, by removing the residual rock not reached by the worn teeth of the wheels or discs.

The modified polygon configuration has the further advantage of preventing the discs becoming engaged in the wall of the hole when the bit is being raised in the hole.

Figure 5:
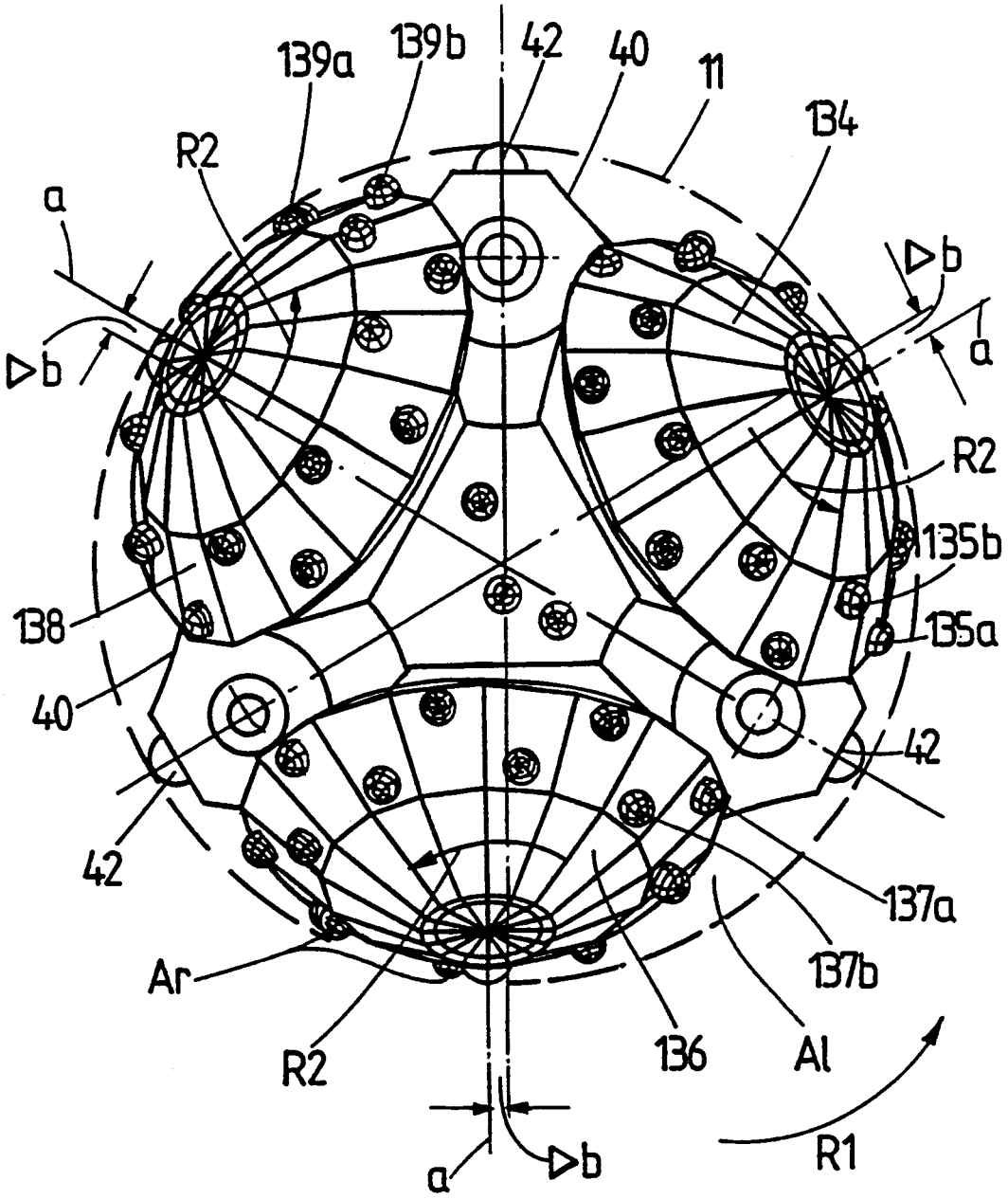
FIG. 5 is a bottom view of a drill bit in a drilled hole, the axes of rotation of the cutting disc being offset in a rearward direction in relation to the direction of rotation of the main body.

FIG. 5 is a bottom view of a drill bit similar to that in FIG. 4. The only difference is the shape or the cutting discs and the teeth disposition pattern.

Apart from the way in which differences in the discs are indicated by the use of different identifying numerals, the same numerals indicate the same elements of the drill bit, from FIG. 3 onwards.

Figure 1:
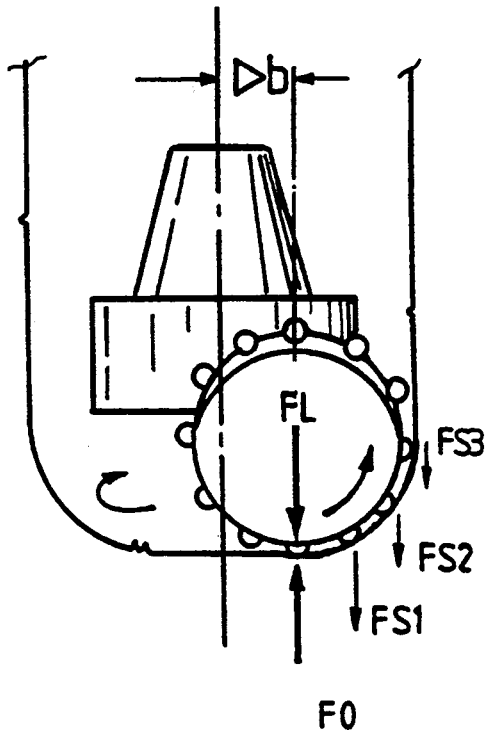
FIG. 1 is a lateral schematic view of a drill bit provided with a rearward offset cutting disc.

The cutting discs 134, 136, 138 of the drill bit shown in FIG. 5 are of frustoconical shape and the cutting teeth 135*a*, 135*b*, 137*a*, 137*b*, 139*a*, 139*b* are disposed according two circular lines in a staggered disposition. The axes of rotation of the disc is laterally offset in a backward direction in relation to the drill bit direction of rotation indicated by the arrow R1. The magnitude of this backward offset is $\Delta b$ which may vary with the diameter of the bit. The direction of rotation of the cutting discs is indicated by the arrow R2. The advantage of the laterally backward offset of the discs has been explained earlier with reference to the FIGS. 1 and 2.

In FIG. 5 is also shown three gauge ring 40 with its teeth 42 displaced so as to ensure a constant hole diameter 11.

The rearward offset disposition of the disc allows a loose/void media area A1 in front upper quadrant of each disc, and a restabilizing area Ar at the rear upper quadrant of the disc 136, these areas are shown in FIG. 5 only in relation to the disc 136 but the same is true with any of the three discs.

Teeth 42 of the gauge ring 40 constitute sizing burnisher tools ensuring a constant diameter of the well. So the teeth of the lower rear quadrant destabilize and cut the well wall, while the teeth of the upper rear quadrant compact the rock in the well wall after cutting.

Figure 6:
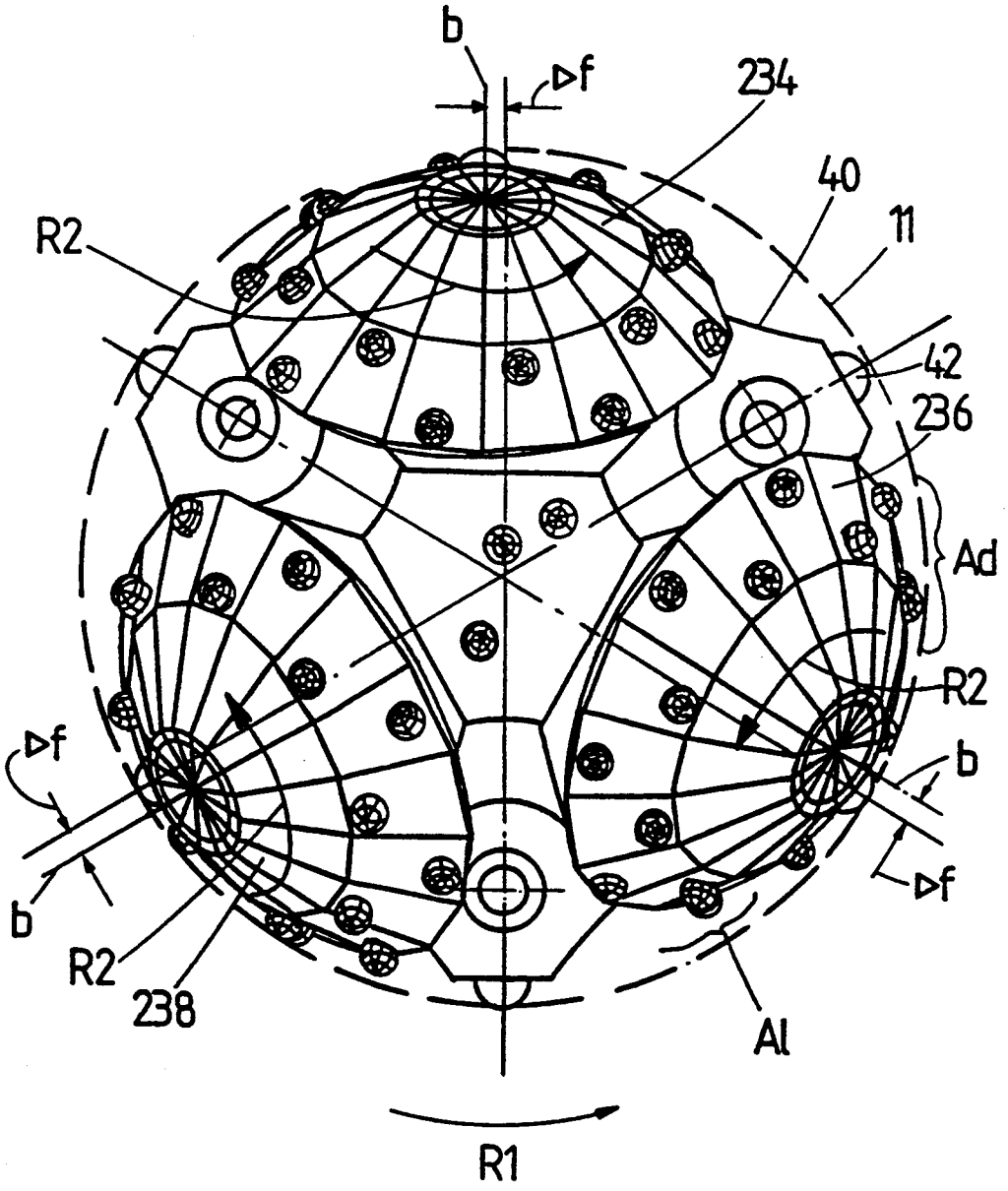
FIG. 6 is a bottom view of a drill bit similar to the drill bit of FIG. 5 the axes of rotation of the cutting discs being offset in a forward direction.

In FIG. 6 is shown a drill bit with three cutting discs 234, 236, 238, whose axes of rotation are laterally forward offset in relation to the drill bit direction of rotation. The magnitude of lateral offset is $\Delta f$.

Figure 2:
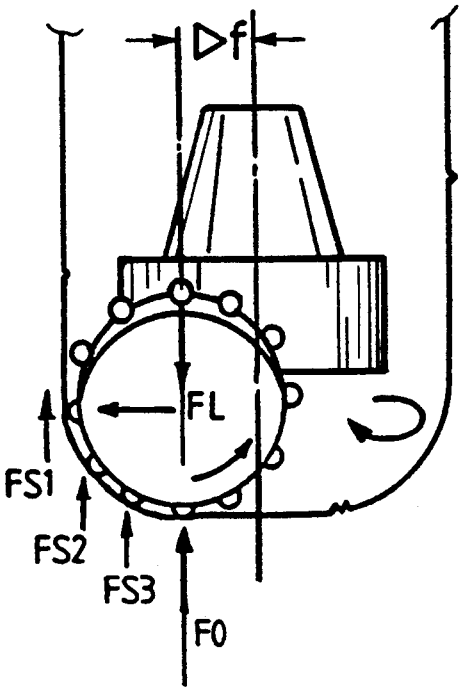
FIG. 2 is a lateral schematic view of a drill bit provided with a forward offset cutting disc.

The disadvantages of this device are already presented in relation to FIG. 2. For each disc the axis of rotation is offset forward, a loose/void media area A1 is situated at the rear upper of the disc while a cutting area Ad is created in front of the disc. So the cutting is carried out by the front lower quadrant of each disc the teeth of which cut the wall by compressing as the disc rotates anticlockwise as opposed to the drill bit in FIG. 5 in which the teeth of lower rear quadrant destabilize and cut the well wall.

Figure 7:
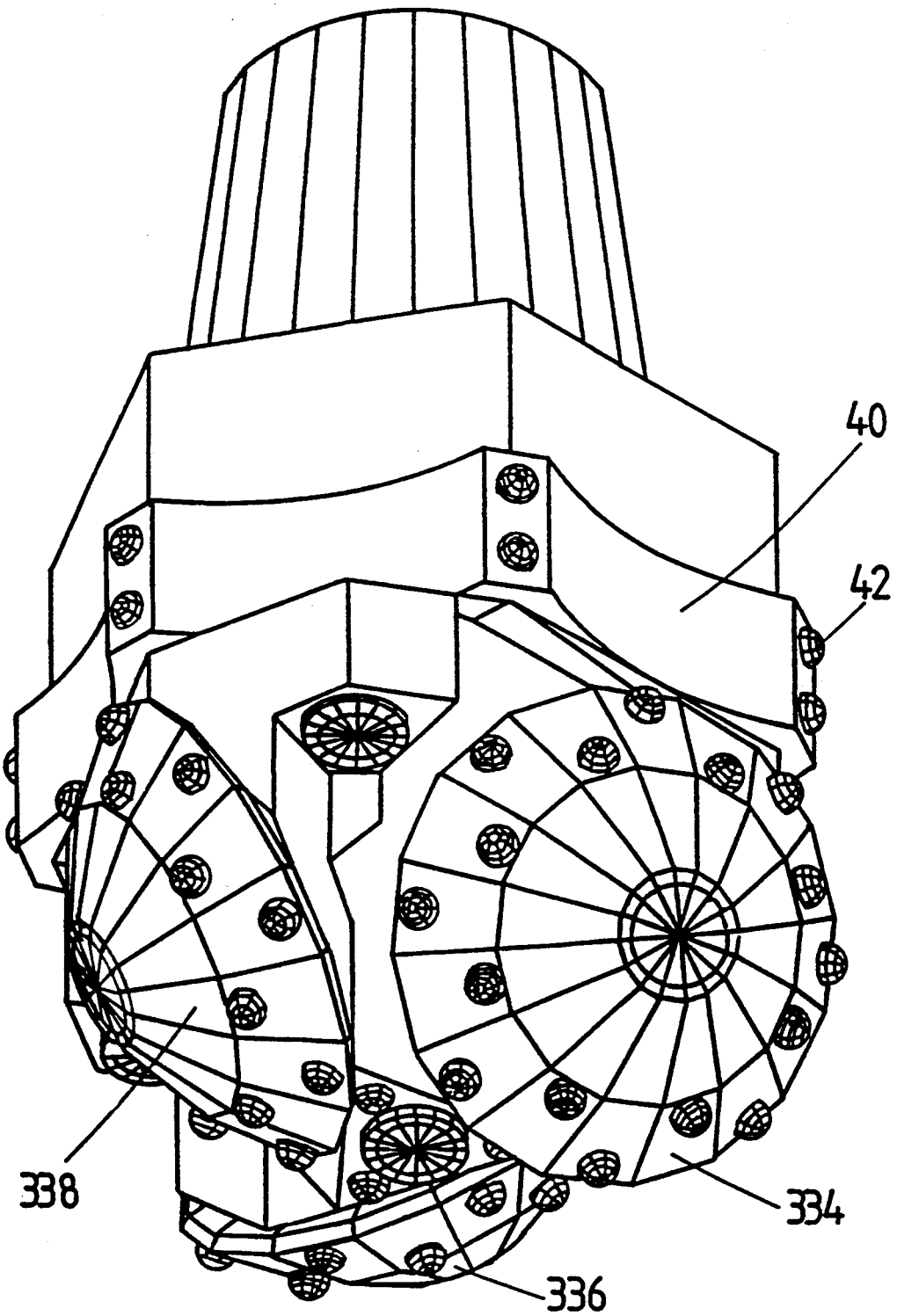
FIG. 7 is a perspective view of a drill bit provided with rearward offset and forward tilted cutting discs.
Figure 8:
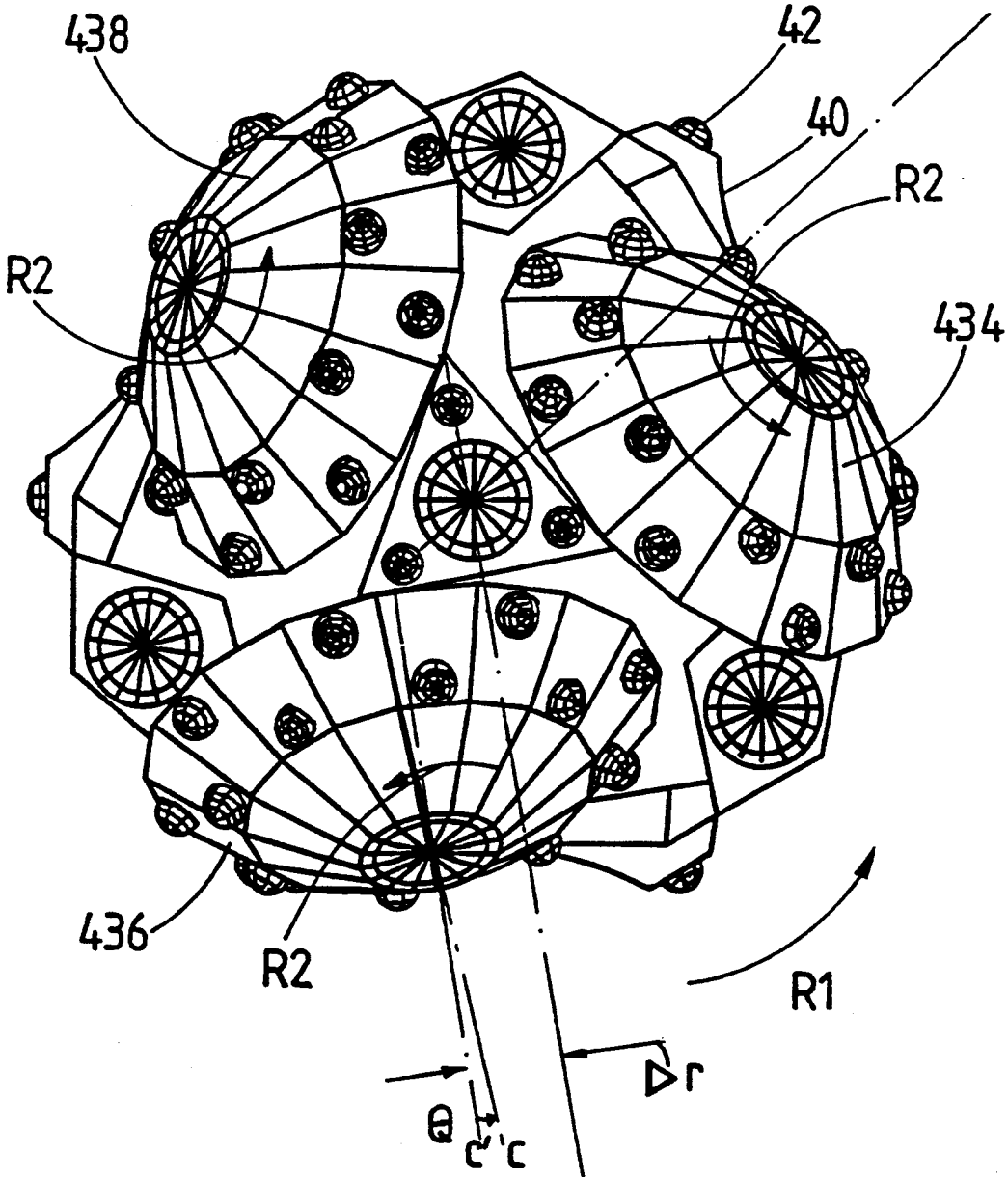
FIG. 8 is the bottom view of the drill bit shown in FIG. 7.

In FIGS. 7 and 8 is shown a drill bit the axis of rotation of each disc being first rearwardly offset in a lateral direction, the magnitude of the offset is $\Delta r$, and after the disc is forward tilted, in relation to the direction of rotation of the drill bit, according to an angle O. This disposition of discs 434, 436, 438, presses the lower rear quadrant of each disc closer to the well wall.

Figure 9:
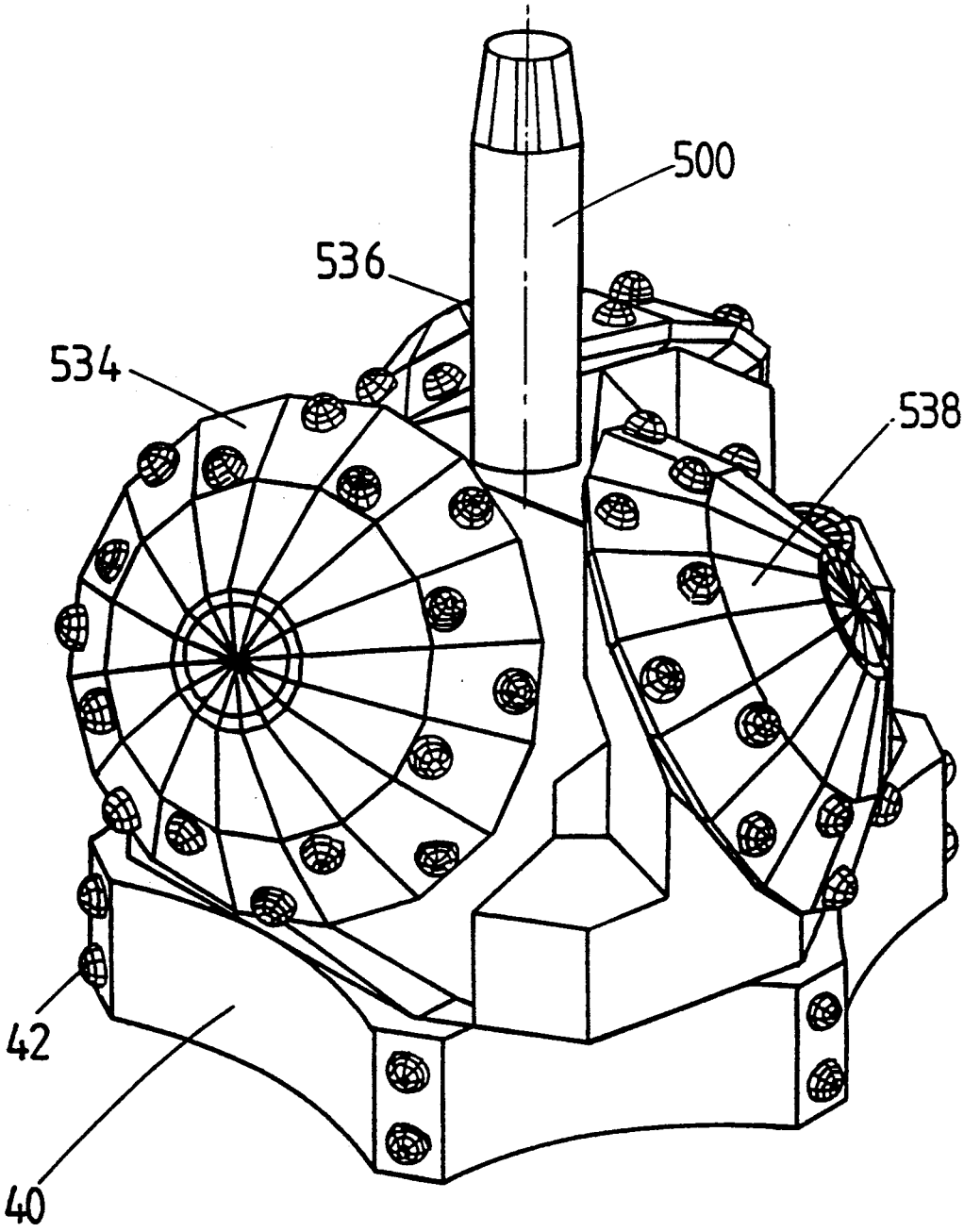
FIG. 9 is a perspective view as in FIG. 7 of a drill bit designed to have the drill rod attached at the base of the bit for drilling upwards.

In FIG. 9 is shown a perspective view of another embodiment according to claim 23. The drilling rod is attached to the bottom portion of the main drill body provided with a male connector 500 in order to make possible to drill upwards. Such a bit may be drilled upward from a tunnel gallery or other space located below the rock into which a small diameter hole has been drilled from the surface for the said drill rod to be lowered to the said tunnel or gallery, so that when the bit is drilled upwards it enlarges the diameter of the hole. In fact the bit shown in FIG. 9 is similar to the bit shown in FIG. 7. It is provided with three cutting discs 534, 536, 538, a gauge ring 40 with burnishing elements 42. The main difference is that the male connector is situated at the lower part of the bit and its shape and dimensions are different. The bit in FIG. 9 is not provided with ducts for supplying drill fluid.

Figure 10:
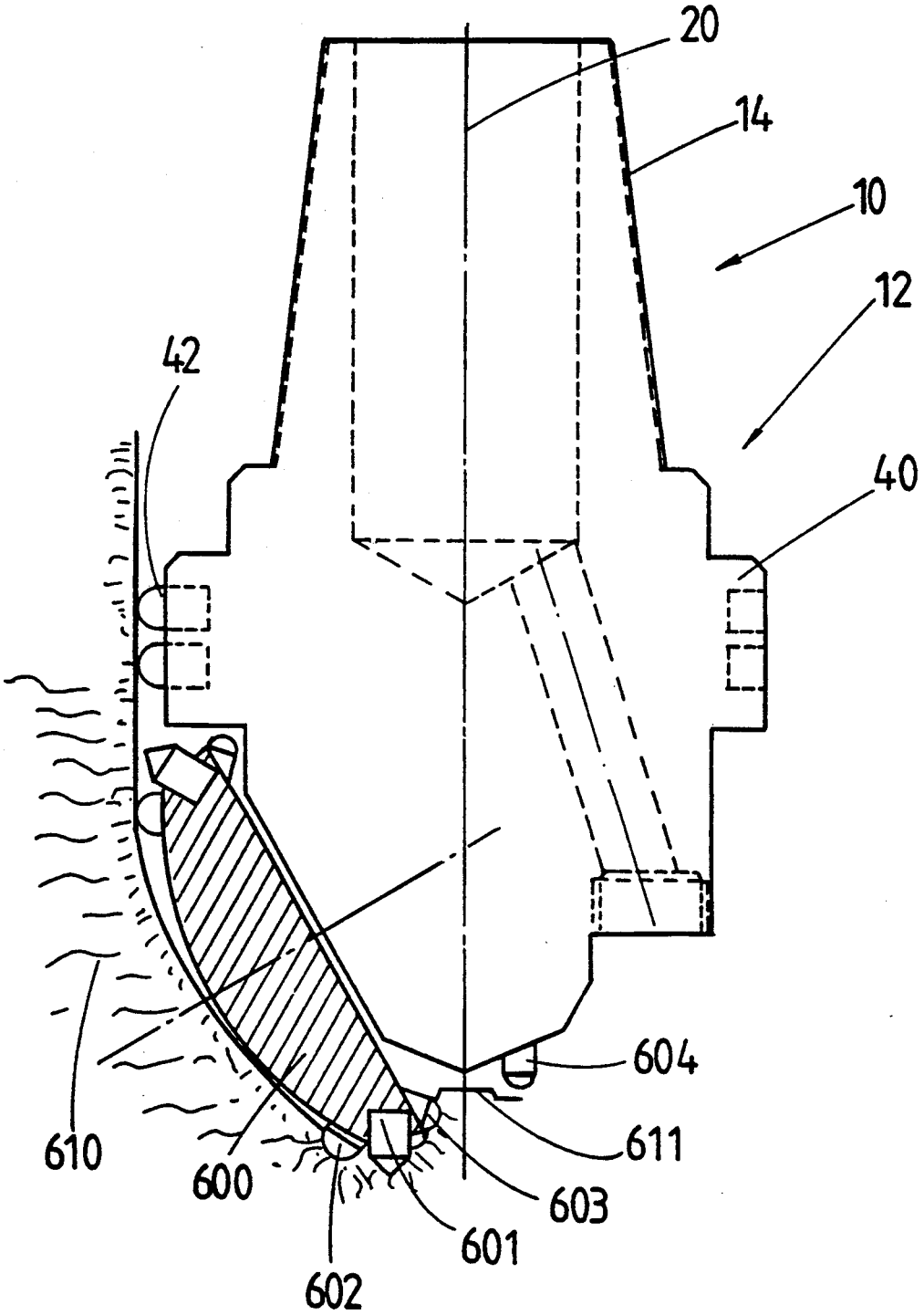
FIG. 10 is a lateral view of a drill bit provided with a single cutting disc.

FIG. 10 is a lateral schematic drawing of a drill bit provided with a single disc 600. The cutting elements of the disc are disposed in three ring shaped formations. The teeth 601 disposed close to the outer periphery of the disc and notably the teeth of the lower rear quadrant penetrate and destabilize the rock 610 radially and then with the teeth 602 located on the outer face of the disc excavate the rock. The teeth 603 situated in the inner-face of the disc break the chimney rock formation 611 left on the bottom of the hole by the cutting disc. Additional cutting or burnishing element 604 at the lower part of the main drill body allow the cutting or burnishing of the chimney 611. The teeth 602 situated on the rear upper quadrant, in relation with the direction of the rotation of the drill body, compact the well wall. So the cutting elements situated on the disc between 6 o'clock to 9 o'clock have to destabilize, evacuate, break and cut the rock, while the teeth situated on the front of the disc between 9 o'clock to 12 o'clock have a compacting action.

Figure 11:
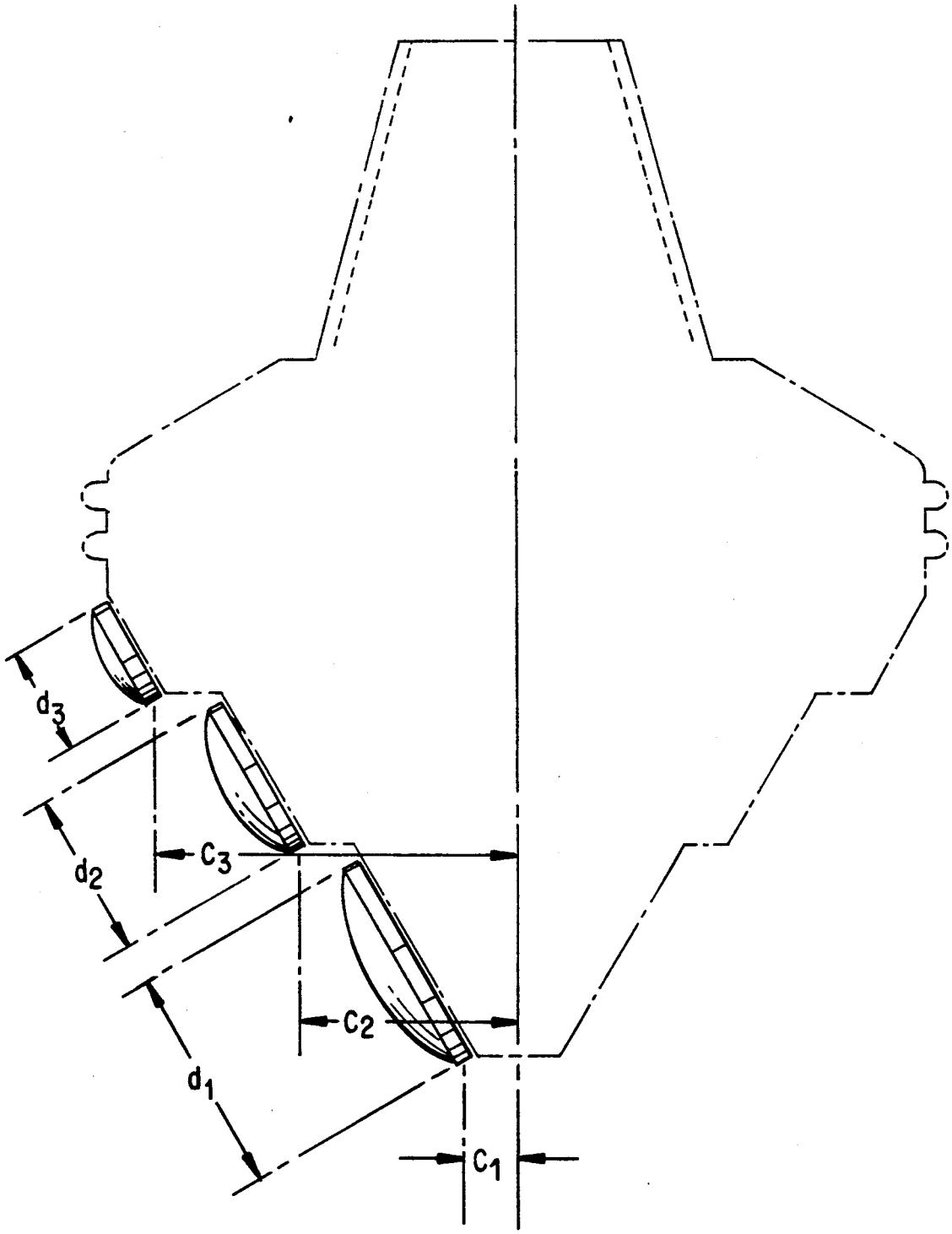
FIG. 11 is a lateral schematic view of a multiple layered disc assembly for drilling wide diameter holes.

FIG. 11 is a lateral schematic view of a multiple layered disc assembly for drilling wide diameter holes. Discs of varying sizes are mounted in concentric rings in a stepped pattern such that the vertical distance of any given disc or discs above the lowest point of the main drill body increases and the diameter of said discs $d_1$, $d_2$, $d_3$, decreases as the radial distance $C_1$, $C_2$, $C_3$, from the centerline of the said main drill body increases. By varying the size and number of the said discs and third position relative to the centerline of the main drill body the stepped cutting profile at the base of the well bore together with the rate of drilling can be varied to suit differing rock types and formations as can the diameter of the well bore.

Thus, the several aforenoted objects and advantages are most effectively attained. Although several preferred embodiments have been disclosed and described in detail herein it should be understood that this invention is in no sense limited thereby but its scope is to be determined by that of the appended claims.

I claim:

1. A drill bit for use in drilling a well bore, comprising a main drill body designed to rotate about a substantially vertically disposed axis of rotation and incorporating at least one longitudinal duct for either supplying a drill fluid or air under pressure to the well bore or removing a drill fluid or air combined with debris and excavated rock from the well bore and intended to be assembled to a drill rod, at least one generally circular, rotatable cutting disc mounted on lower portion outside of the said main drill body, causing the said drill bit to form a well bore having a substantially cylindrical wall portion and a generally concave portion, the said cutting disc having cutting elements disposed in generally ring-shaped formations, with its axis of rotation disposed at an acute angle to the axis of rotation of the main body, the lowest cutting point of the said disc being radially remote in relation to the axis of rotation of the drill body, the axis of rotation of the cutting disc being slightly offset laterally in a rearward direction from the centerline of the said main drill body in relation to the direction of rotation of the main drill body, while leaving all angles between the axes unchanged, causing the entire bit to be placed in a nonequilibrium position, the rotation of the said main body enabling the disc to seek equilibrium by the cutting elements penetrating the well wall and shearing the rocks as the combined downward forces exceed the opposing forces (making the drill bit self-loading), the downward force being essentially concentrated around the lowest cutting element causing a destabilization of the well wall making easier the cutting action of the bit.

2. The drill bit according to claim 1 in which the cutting elements on the discs are disposed in at least three ring shaped formations, the middle ring being close to the outer periphery of the cutting disc while the other rings are respectively located on the outer and inner face of the disc, the lowest cutting elements in the lower rearward quadrant of the middle ring penetrate and destabilize the rock while the outer and inner cutting elements excavate the destabilized rock and the outer cutting elements in the rearward quadrant compact and burnish the wall of the hole.

3. The drill bit as defined in claim 2 in which the axis of rotation of the cutting disc is further tilted in the direction of rotation of the main body by changing the angle of the axis of rotation in relation to the centerline of the main drill body.

4. The drill bit as defined in claim 1 in which the extent of non-equilibrium of the said cutting disc is proportional to the distance by which the axis of rotation of the said cutting disc is offset.

5. The drill bit as defined in claim 1 in which the rotational force needed for the said cutting disc to reach equilibrium is proportional to the downward thrust on the bit.

6. The drill bit as defined in claim 1 in which the achievement of the rotational force needed for the cutting disc to reach equilibrium is proportional to the length, width and profile of the cutting elements.

7. The drill bit as defined in claim 1 in which the achievement of the rotational force needed for the said cutting disc to reach equilibrium is proportional to the condition of the rock.

8. The drill bit as defined in claim 2 in which two cutting discs are mounted at spaced intervals.

9. The drill bit as defined in claim 2 in which three cutting discs are mounted at spaced intervals.

10. The drill bit as defined in claim 2 which multiple cutting discs are mounted at spaced intervals.

11. The drill bit as defined in claim 2 in which multiple cutting discs are mounted at spaced intervals and multiple bits are mounted at specified locations to create a large combination bit capable of drilling wide diameter holes, said discs and bits to be arranged at varying heights in relation to each other so as to create a stepped cutting profile at the base of the well bore.

12. The drill bit as defined in claim 2 in which multiple cutting discs or multiple bits are mounted at specified locations to create a large combination bit capable of drilling wide diameter holes, said discs or bits to be arranged at varying heights in relation to each other so as to create a stepped cutting profile at the base of the well bore.

13. The drill bit as defined in claim in which there is an acute angle between the rotating axis of the said cutting disc, and the rotating axis of the said main drill body.

14. The drill bit as defined in claim 1 in which the amount of lateral offset of the axis of rotation of each of the said cutting discs from the centerline of the said main drill body is approximately 1/32 to ¼ inch.

15. The drill bit as defined in claim 1 in which the amount of lateral offset of the axis of rotation of each of the said cutting discs from the centerline of the said main drill body is approximately ¼ inch to 1 inch or more.

16. The drill bit as defined in claim 1 in which said rotatable cutting discs are dynamically balanced, and are placed so as to effectively counter-react to each other, and the drill bit is self-aligning.

17. The drill bit as defined in claim 1 in which the supplementary cutting disc is mounted on the vertical axis, at the lowest point of the said main drill body, the plane of the disc being perpendicular to the axis of rotation of the said main drill body, in order to disrupt any rock chimney left by the rotatable cutting discs.

18. The drill bit as defined in claim 1 in which said cutting discs are substantially flat discs.

19. The drill bit as defined in claim 1 in which the said cutting discs are substantially concave in their outer surface.

20. The drill bit as defined in claim 1 in which the said cutting discs are substantially convex in their outer surface.

21. The drill bit as defined in claim 1 in which upper portion of the said main drill body is polygonal in shape, with the various burnishing or cutting elements positioned facing outward on the said main drill body.

22. The drill bit as defined in claim 1 in which the said upper portion of the said main drill body is hexagonal in shape, and incorporates a member of burnishing or cutting elements.

23. The drill bit as defined in claim 1 in which the upper portion of the said main drill body has a number of burnishing elements disposed at regular intervals around the periphery of the said main drill body, and no lower than the points at which the concave bottom portion of the well bore joins the cylindrical wall portion, the use of the said burnishing or cutting elements around the circumference of the said main drill body being to assure a constant desired size of well bore diameter, even when the cutting elements in the said cutting disc are worn, and also to assure a subsequent compaction and burnishing of the well wall destabilized and excavated by the said cutting discs.

24. The drill bit as defined in claim in which upper portion of the said main drill body has a number of burnishing or cutting elements disposed at regular intervals around the periphery of the said main drill body, and no lower than the point at which the concave bottom portion of the well bore joins the cylindrical wall portion, the said burnishing or cutting elements being positioned in such a way that they form a cylindrical wall portion, of a maximum diameter greater than the diameter of the hole formed by the said cutting discs, the said burnishing elements on the upper portion of the said main drill body serving to radially compress the well wall and compact it after the destabilization and excavation caused by the said cutting discs.

25. The drill bit as defined in claim 1 in which the said main drill body is provided with means adapted to drive it in rotation even if the drill rod is not in rotation, as when the bit has been deviated to alter the direction of penetration.

26. The drill bit as defined in claim 25 in which the said means of rotation comprises at least one driven turbine.

27. The drill bit as defined in claim in which there are no longitudinal ducts for supplying a drill fluid, and in which the drill rod is attached longitudinally to the bottom portion of the said main drill body in such a way that the bit may be drilled upward from a tunnel, gallery or other space located below the rock into which a hole has been drilled from the surface by a small diameter bit of sufficient diameter for the said drill rod to be lowered down the hole from the surface to the said tunnel, gallery or other space to be attached to the said drill bit, so that as the bit is drilled upwards it enlarges the diameter of the hole, and the debris fall backwards down the hole behind the bit into the said tunnel, gallery or other space to be collected and removed, the lateral offset of the axis of rotation of the said cutting disc from the centerline of the said main drill body is rearward relative to the direction of rotation of the said main drill body which will rotate in the opposite direction to the direction of rotation of the said main drill body when the bit is drilling normally downwards since the direction of rotation of the said drill rod remains the same but the said drill rod is now attached to the opposite end of the said main drill body.

28. The drill bit as defined in claim 1 in which a supplementary cutting disc is mounted on the vertical axis, at the lowest point of the said main drill body and comprising a means adapted to drive the said supplementary cutting disc in rotation independent of the rotation or lack of rotation of the said main drill body.

* * * * *